US005868211A

United States Patent [19]

Bohn

[11] Patent Number: 5,868,211

[45] Date of Patent: Feb. 9, 1999

[54] BALL AND SOCKET MOUNTED HYDRAULIC POSTHOLE DIGGER AND METHOD FOR USING THE SAME

[76] Inventor: Timothy James Bohn, P.O. Box 275, Sentinel Butte, N. Dak. 58654

[21] Appl. No.: 856,268

[22] Filed: May 14, 1997

[51] Int. Cl.[6] ..... E21B 1/02; E21B 7/02; E21J 7/02

[52] U.S. Cl. ..... 175/170; 175/57; 175/122; 173/27; 173/28; 173/29; 37/403

[58] Field of Search ..... 175/57, 122, 162, 175/323, 170; 173/185, 213, 24, 27, 28, 29; 172/253; 37/403, 404, 406, 468, 903; 403/76, 122; 280/495, 509, 511

[56] References Cited

U.S. PATENT DOCUMENTS

| | | | |
|---|---|---|---|
| 2,774,568 | 12/1956 | Jones . | |
| 3,327,789 | 6/1967 | Furuseth | 173/38 |
| 3,638,741 | 2/1972 | Zizak . | |
| 3,700,045 | 10/1972 | Coontz . | |
| 3,789,931 | 2/1974 | Quinn . | |
| 3,976,147 | 8/1976 | Cunningham . | |
| 4,066,134 | 1/1978 | Karns, III | 173/27 |
| 4,199,033 | 4/1980 | Van Gundy, Jr. | 37/403 X |
| 4,417,628 | 11/1983 | Gessner | 173/29 |
| 4,915,180 | 4/1990 | Schisler . | |
| 4,961,471 | 10/1990 | Ovens . | |
| 5,090,486 | 2/1992 | Jones . | |
| 5,396,967 | 3/1995 | Stewart . | |
| 5,437,341 | 8/1995 | Horn et al. . | |
| 5,517,774 | 5/1996 | Rogers | 175/57 X |
| 5,556,217 | 9/1996 | Deyo et al. | 403/61 |

*Primary Examiner*—Tamara L. Graysay
*Assistant Examiner*—Sunil Singh
*Attorney, Agent, or Firm*—Curtis V. Harr

[57] ABSTRACT

A portable hydraulically driven posthole digger is provided. The present invention is mounted to an existing loader-type tractor or skid steer loader by the use of a ball and socket type attachment such as a trailer ball and trailer tongue apparatus. The tongue is mounted vertically above the post hole digger and the trailer ball is mounted on the loader such as the bucket on a front end loader. The posthole digger's hydraulic motor is powered off of the existing hydraulic system of the equipment being used. This configuration not only provides an inexpensive method of digging post holes, but further requires a minimal amount of mounting hardware and can be easily removed and stored when not in use.

11 Claims, 7 Drawing Sheets

BALL AND SOCKET MOUNTED HYDRAULIC POSTHOLE DIGGER AND METHOD FOR USING THE SAME

BACKGROUND OF THE INVENTION

The present invention relates to an improvement in the auger type posthole digger. More specifically, an improvement in the manner in which a portable posthole digger is employed in the digging of holes in the earth for the placement of such things as fence posts, mailbox poles, deck posts, playground equipment and sign posts.

In the past, people who frequently had the need to excavate relatively narrow and deep cylindrical holes in the earth for the anchoring of posts, such as ranchers and construction companies, mainly used one of three available means to do so. The first of these was a hand held gasoline powered auger type device. The major problem with this method is that it is dangerous, often wrenching out of the operator's control when encountering varying soil conditions, consistencies and rocks. The hand held digger generally requires at least two people to operate effectively. Additionally, the amount of force required to drive the posthole digger far enough into the earth to create a hole of sufficient depth is very difficult to apply to such a device.

The second option available was a post hole digger that is mounted on its own independently powered and transportable trailer-type device. These types of devices are illustrated in U.S. Pat. Nos., 5,396,967 (Stewart) and 3,976,147 (Cunningham). While these devices provide stability and are operable by a single user, the expense of such devices can be prohibitive to small companies and individuals to own and operate. They are also quite cumbersome and difficult to move from one drilling location to another. Additionally, they may still require the user to apply manual down force to drive the auger into the earth.

A third type of posthole digger has been the attachment-type digger as illustrated by U.S. Pat. No. , 3,789,931 (Quinn). This type of device is typically attached to the front loader portion of a tractor or skid steer loader. Loader tractors and skid steers (hereinafter referred to as loader tractors or loader type tractors in general) are typically used by ranchers and construction companies and thus, make an ideal power source for operating a posthole digger. The problem has been that until this time posthole diggers for loaders have required a large amount of mounting hardware in order to allow the posthole digger to properly move side to side and fore and aft. Thus, these posthole diggers have required substantial time and effort to convert the loader between a posthole digger and useable loader tractor. Further, posthole diggers of this type may only work with specific loader type attachments due to certain mounting requirements.

From the foregoing discussion, it can be seen that it would be highly desirable to provide a method of digging postholes that is easily used by one person, that is stable and safe in its use, and is inexpensive. Further, it is desirable to provide such equipment that can be used in conjunction with existing loader type equipment capable of applying the down force necessary to drive the posthole digger to a sufficient depth into the earth. Finally, it can be seen that it would be desirable to provide such a method that could be easily engaged to and disengaged from equipment already existing in the user's inventory.

SUMMARY OF THE INVENTION

It is the primary objective of the present invention to provide a means of digging postholes in a fashion that can be easily accomplished by one person.

It is an additional objective of the present invention to provide a means of digging postholes that is independently stable and safe in its operation.

It is a further objective of the present invention to provide an efficient and inexpensive means of digging postholes that implements the use of existing equipment rather than requiring the user to purchase an expensive, self-contained apparatus or use excess mounting hardware.

It is still a further objective of the present invention to provide a posthole digger in which the auger portion is easily reversible in its rotational direction to facilitate the easy removal of the posthole digger auger from the completed posthole.

Finally, it is the objective of the present invention to provide a means by which existing hydraulic equipment can be used to provide the downward force necessary to drive the auger portion of the posthole digger into the earth.

These objectives are accomplished by the use of a hydraulically driven posthole digger, which is mounted by the use of a ball and socket type apparatus. One such type of ball and socket that has been found to be ideally suited for this use is a trailer ball and trailer tongue apparatus, the tongue being mounted vertically above the posthole digger and the trailer ball being mounted to existing equipment, such as the bucket on a front end loader. The posthole digger is supplied with a hydraulic motor which may be powered by the existing hydraulic system of the loader equipment being used. The use of a trailer tongue type socket and ball has been found to function properly with several advantages as parts are readily available and balls may be mounted on several loader attachments without the need for specialized parts. The use of a common trailer tongue and ball not only provides an inexpensive method of digging postholes, but the mechanism can easily be removed and stored when not in use. The use of the ball and socket supplies a means of attaching a posthole digger to a loader with minimal hardware yet allows the posthole digger to pivot in all directions while being subject to quick installation, attachment and removal on virtually any loader bucket without special rigging. It should be recognized that the present invention would function equally well with heavier or custom ball and socket configurations and thus, the present invention includes other ball and socket type connections that may be used apart from trailer connections.

For a better understanding of the present invention reference should be made to the drawings and the description in which there are illustrated and described preferred embodiments of the present invention.

DESCRIPTION OF THE PREFERRED EMBODIMENT

Figure 1:
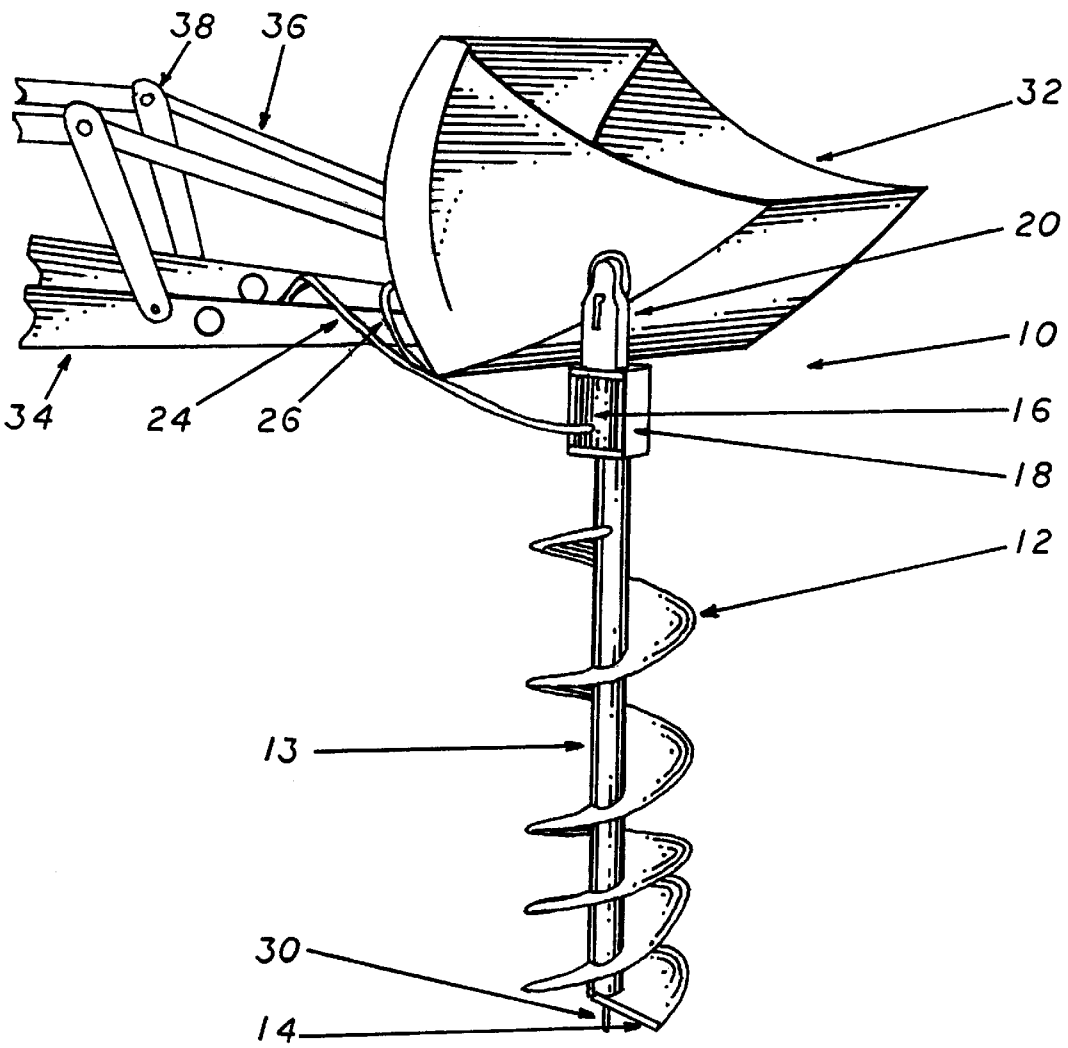
FIG. 1 is a perspective view of the Ball and Socket Mounted Hydraulic Posthole Digger showing its major components and the orientation of its mounting on existing equipment.
Figure 2:
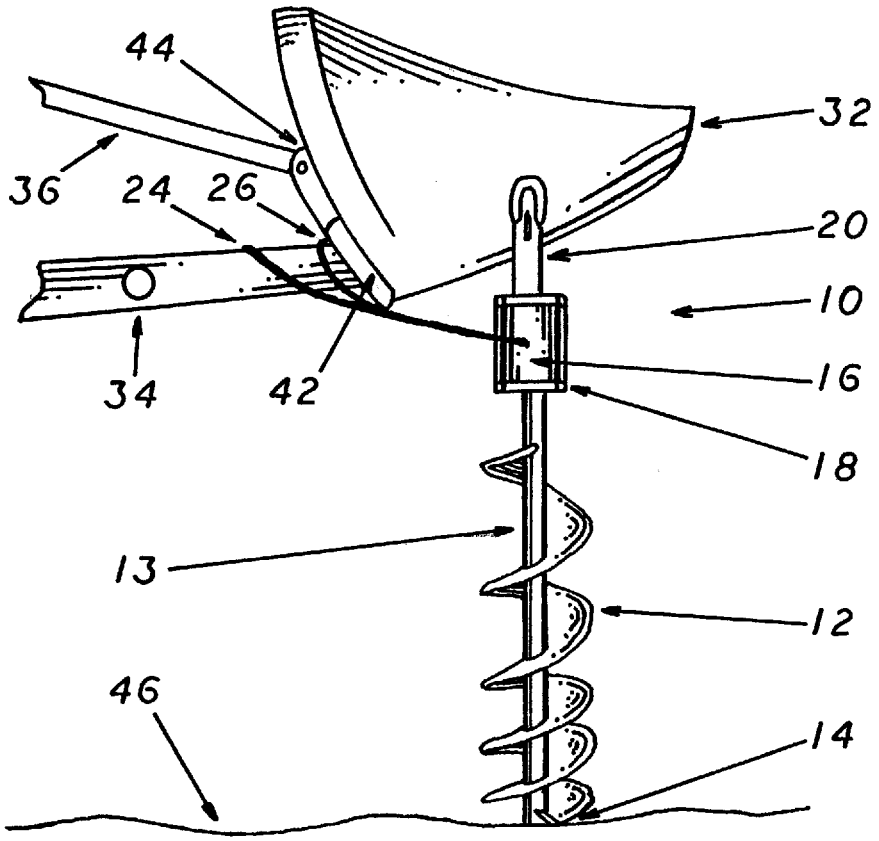
FIG. 2 is a side elevation view of the present invention showing the orientation of its major components in relation to the ground prior to the commencement of operation.
Figure 3:
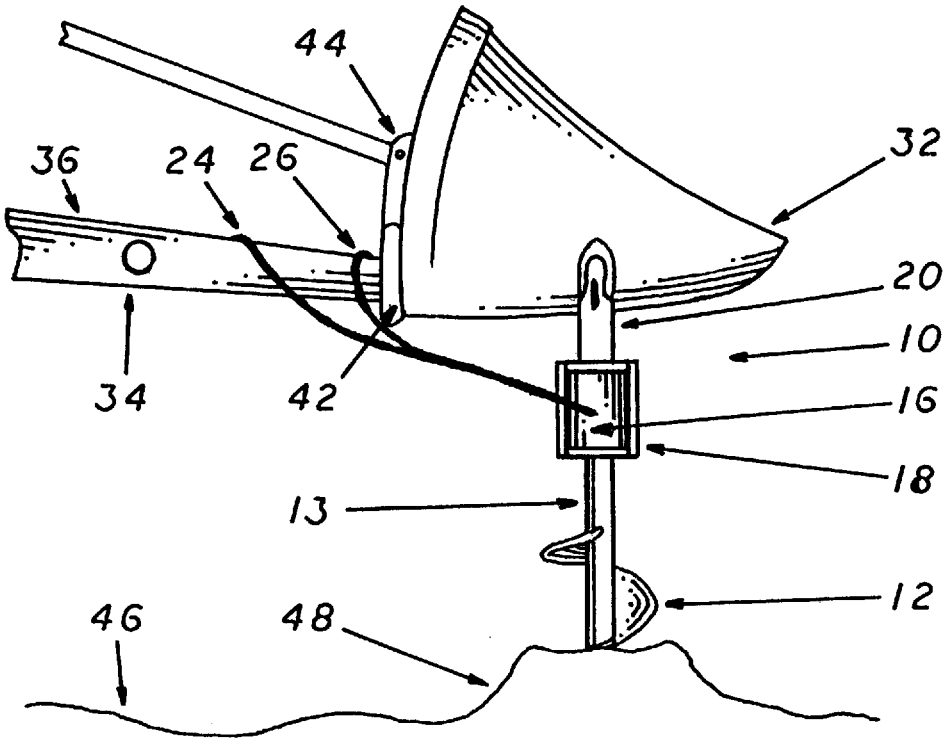
FIG. 3 is a side elevation view of the present invention showing the orientation of its major components in relation to the ground at the completion of the digging operation and prior to removal from the completed posthole.
Figure 4:
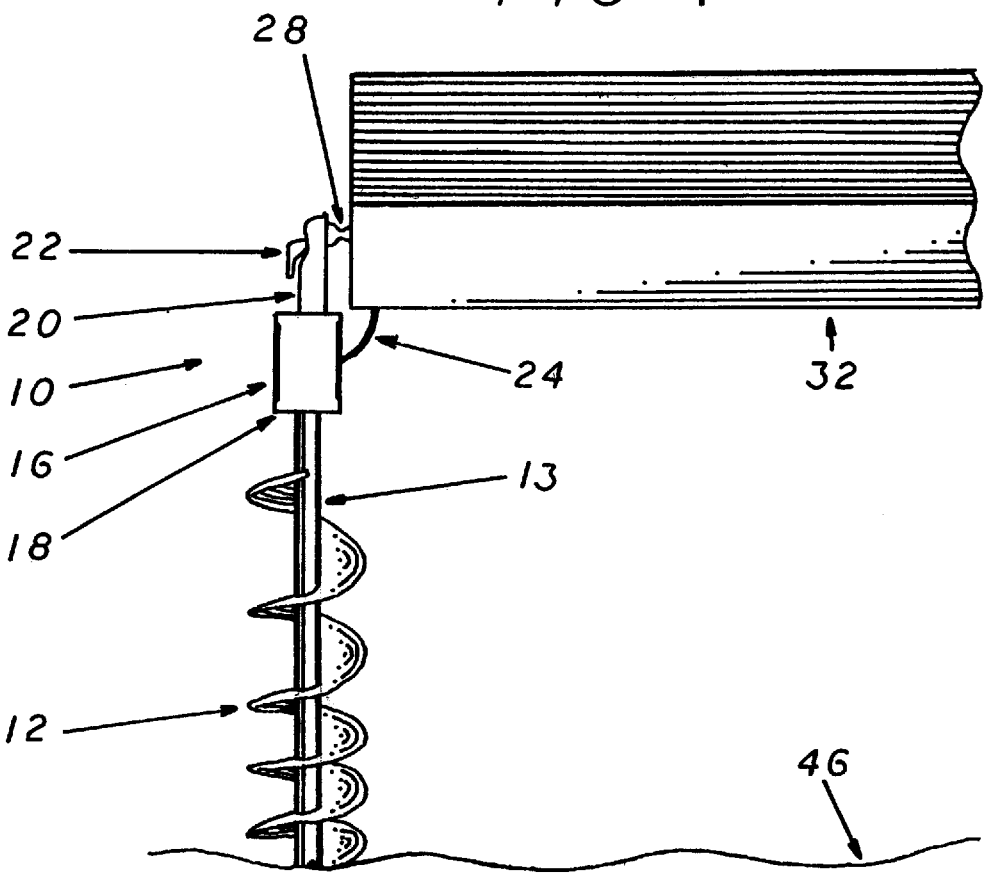
FIG. 4 is a front elevation view of the present invention showing the orientation of its major components in relation to the ground prior to the commencement of operation.
Figure 5:
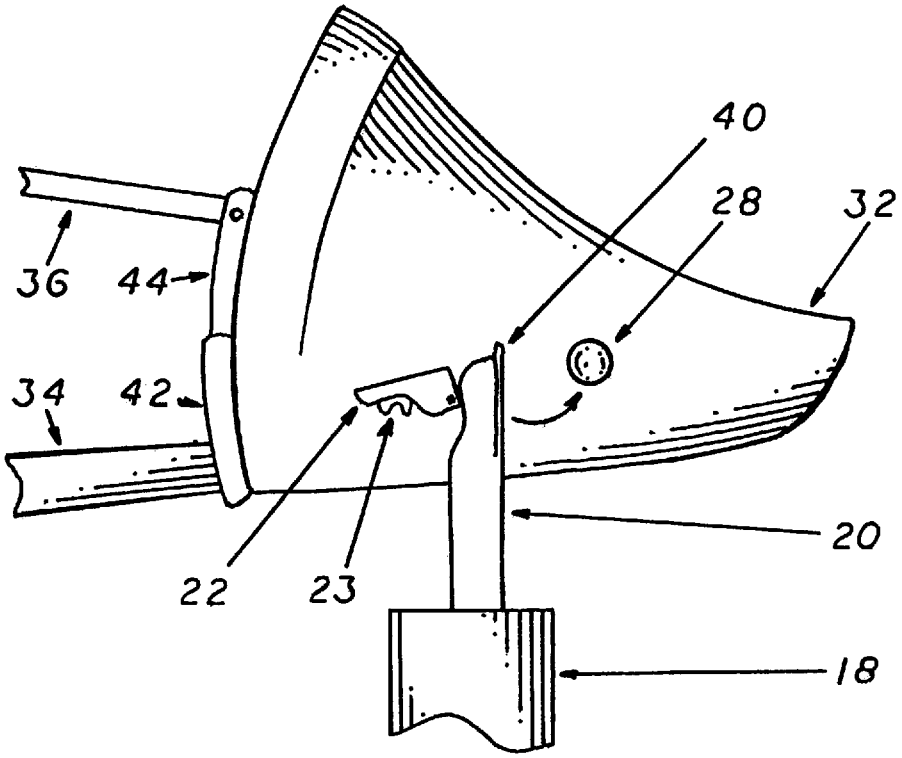
FIG. 5 is a side elevation view of the present invention showing the manner in which the trailer tongue connects to the trailer ball mounted to the bucket of a front end loader.
Figure 6:
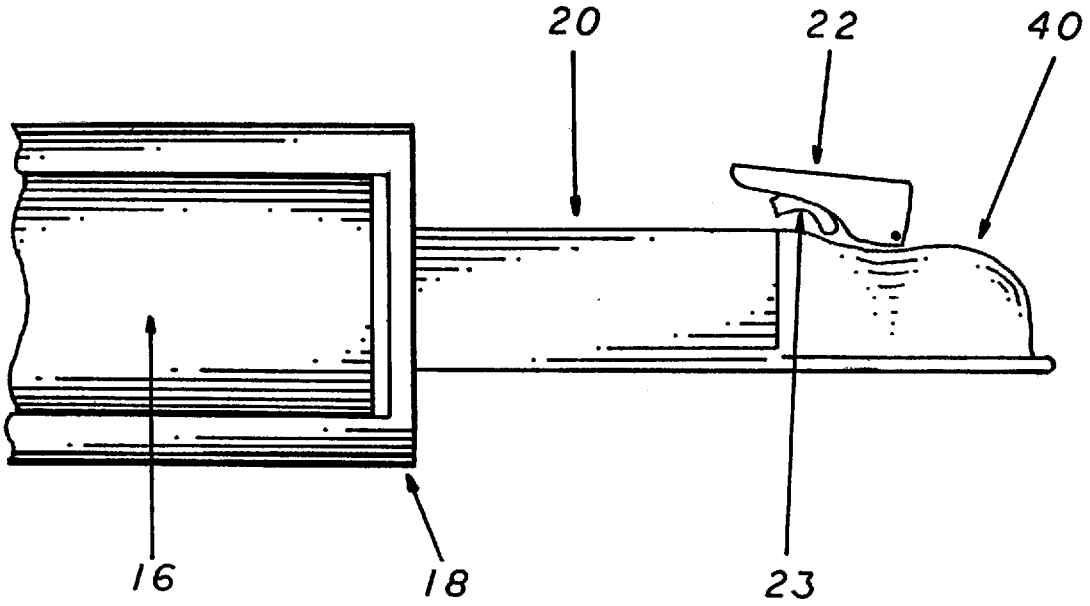
FIG. 6 is a side elevation view of the hydraulic motor and the trailer tongue of the present invention showing its method of construction.
Figure 7:
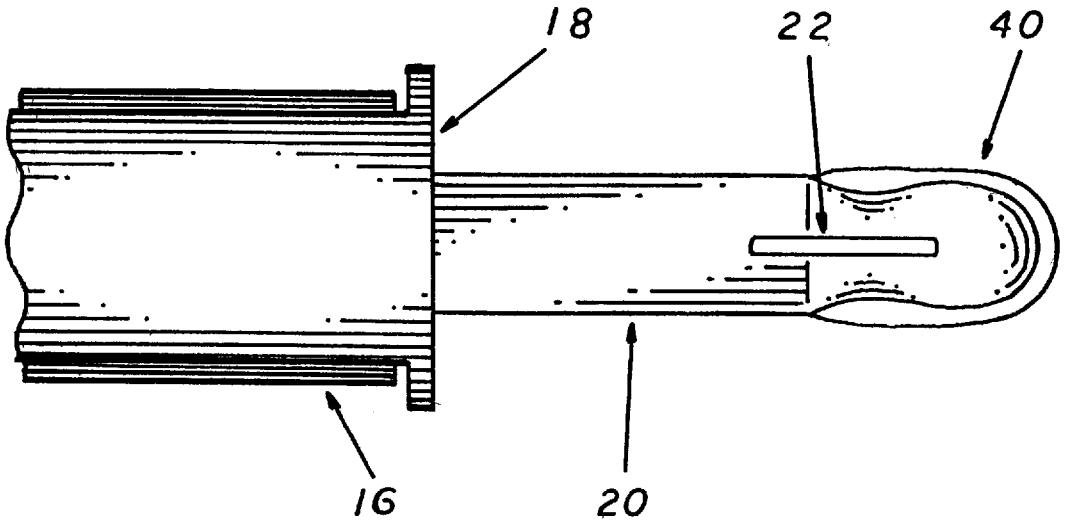
FIG. 7 is a front elevation view of the hydraulic motor and the trailer tongue of the present invention showing its method of construction.

Referring now to the drawings, and more specifically to FIGS. 1–7 inclusive the Ball and Socket Mounted Hydraulic Posthole Digger 10 comprises a reversible hydraulic motor 16 which is mounted in the motor box 18. Extending downward from the reversible hydraulic motor 16 and motor box 18 is the posthole digger shaft 13 onto which the posthole digger auger 12 is attached. The lower most end of the posthole digger shaft 13 has a shaft pilot screw 30 extending downward which serves to keep the posthole digger shaft 13 centered during the initial phases of digging a posthole. The leading or most downward potion of the posthole digger auger 12 has attached to it the posthole digger blade 14 which serves as the primary earth digging component of the present invention. As the Ball and Socket Mounted Hydraulic Posthole Digger 10 augers into the earth, the removed soil 48 is funneled up the corkscrew shaped posthole digger auger 12 and expelled at the top of the posthole.

The top of the motor box has permanently attached to it and extending upward the trailer tongue 20. This feature of the present invention is a commonly used trailer tongue 20 which is employed in the present invention to anchor the Ball And Socket Mounted Posthole Digger 10 at its upper most end to a potion of existing equipment such as the loader bucket 32 of a front end loader. This connection is facilitated by fastening a ball type attachment 28 to the loader bucket 32 in a manner such that it extends outward to allow for the easy attachment of the socket or trailer tongue 20 portion of the present invention. The desired connection is accomplished by placing the trailer tongue receptacle 40 portion of the trailer tongue 20 over the trailer ball 28 and locking the trailer tongue into position by moving the trailer ball clamp lever 22 into a horizontal position in relation to the top surface of the trailer tongue 20. To remove the present invention from the trailer ball 28 one depresses the clamp release 23 located on the trailer ball clamp lever 22 between it and the trailer tongue 20 and then moves the trailer ball clamp lever 22 back to vertical position on relation to the trailer tongue 20. With this accomplished, the present invention can be easily removed from the loader bucket 32 for storage when not in use.

The downward forces necessary to drive the Ball and Socket Mounted Hydraulic Posthole Digger 10 into the ground 46 are provided by the vehicle being used. Typically, an implement such as a loading bucket 32 is capable of being raised and lowered by the use of hydraulic force. The loader bucket 32 is pivotally connected to the vehicle by the means of a bucket suspension lower arm 34, and a bucket suspension upper arm 36 at the lower arm attachment brackets 42 and the upper arm attachment brackets 44. These are in turn pivotally attached to one another by the bucket suspension cross member 38. This framework can be manipulated by the vehicle operator to either raise or lower the loader bucket 32 or to change the angle of the loader bucket 32 in relation to the ground 46. Thus, the operator uses the vehicle's hydraulic system to force the present invention into the ground 46 by lowering the loading bucket 32 and removes it from the ground 46 by raising the loading bucket 32.

The hydraulic pressure needed to turn the reversible hydraulic motor 16 is also supplied by the vehicle's existing hydraulic system. A high pressure hydraulic line 24 runs from the vehicle to the reversible hydraulic motor 16 which provides the necessary rotational force to the hydraulic motor and a hydraulic return line 26 returns the hydraulic fluid to the vehicle's hydraulic system. These lines can be easily removed when the present invention is not in use.

Although the present invention has been described in considerable detail with reference to certain preferred versions thereof, other versions are possible. For example various ball and socket type connections may be used apart from trailer parts. Further, it should be recognized that the present invention is usable on various loader attachments from buckets to forks. Therefore, the spirit and scope of the appended claims should not be limited to the description of the preferred versions contained herein.

What is claimed is:

1. A posthole digging apparatus comprising:

a loader tractor means having a hydraulic system with a loader attachment means;

a ball means fixably attached to said loader attachment means;

a hole digging auger having a lower portion supplied with a blade and an upper portion;

an upper drive means portion attached to the upper portion of said auger and capable of turning said auger;

a socket means fixedly attached to and extending upward from said upper drive means, said socket means being capable of removably attaching to said ball means and of pivoting fore, aft and side to side about said ball means.

2. The posthole digging apparatus of claim 1 wherein said socket means is a trailer tongue type attachment having a socket and lockable clamp portion within said socket.

3. The posthole digging apparatus of claim 2 wherein said upper drive means portion comprises a hydraulically driven motor and a motor box.

4. The posthole digging apparatus of claim 3 further comprising a pair of hydraulic lines connecting said drive means with said loader tractor hydraulic system.

5. A posthole digging apparatus for use with a loader type tractor having a hydraulic system and a hydraulically driven loader attachment means said posthole digging apparatus comprising:

a ball means fixably attached to said loader attachment means;

a hole digging auger having a lower portion supplied with a blade and an upper portion;

an upper drive means portion attached to the upper portion of said auger and capable of turning said auger;

a socket means fixedly attached to and extending upward from said upper drive means, said socket means being capable of removably attaching to said ball means and of pivoting fore, aft and side to side about said ball means.

6. The posthole digging apparatus of claim 5 wherein said socket means is a trailer tongue type attachment having a socket and lockable clamp portion within said socket.

7. The posthole digging apparatus of claim 6 wherein said upper drive means portion comprises a hydraulically driven motor and a motor box.

8. The posthole digging apparatus of claim 7 further comprising a pair of hydraulic lines connecting said drive means with said loader tractor hydraulic system.

9. A method of digging postholes with a loader type tractor having a hydraulic system comprising the steps of:

(A) suppling the loader of said loader type tractor with a hitch type ball;

(B) attaching an auger type hydraulically powered posthole digger to said ball via a removable socket about said ball; and (C) connecting said posthole digger to said hydraulic system of said tractor with a pair of hydraulic lines.

10. The method of digging postholes as in claim 9 further comprising the steps of:

(D) turning said auger type posthole digger via the hydraulic system of said loader type tractor;

(E) lowering said loader of said loader type tractor so as to drive said posthole digger into the ground; and (F) raising said loader of said loader type tractor so as to remove said posthole digger from said ground.

11. The method of digging postholes as in claim 10 further comprising the step of:

(G) disconnecting said posthole digger hydraulic lines from said hydraulic system of said loader type tractor; and (H) removing said posthole digger from said ball.

* * * * *